US008579156B2

(12) United States Patent
Rasmussen et al.

(10) Patent No.: US 8,579,156 B2
(45) Date of Patent: Nov. 12, 2013

(54) APPARATUS AND METHOD FOR CLEANING AND FLUSHING A BEVERAGE DISPENSING SYSTEM

(75) Inventors: Jan Norager Rasmussen, Olstykke (DK); Steen Vesborg, Gentofte (DK)

(73) Assignee: Carlsberg Breweries A/S, Copenhagen (DK)

( * ) Notice: Subject to any disclaimer, the term of this patent is extended or adjusted under 35 U.S.C. 154(b) by 211 days.

(21) Appl. No.: 13/063,177

(22) PCT Filed: Sep. 10, 2009

(86) PCT No.: PCT/EP2009/061742

§ 371 (c)(1), (2), (4) Date: Apr. 21, 2011

(87) PCT Pub. No.: WO2010/029122

PCT Pub. Date: Mar. 18, 2010

(65) Prior Publication Data

US 2011/0186600 A1 Aug. 4, 2011

(30) Foreign Application Priority Data

Sep. 11, 2008 (EP) ..... 08388029

(51) Int. Cl.
*B67B 7/00* (2006.01)

(52) U.S. Cl.
USPC ..... 222/1; 222/148; 222/82; 222/94; 222/325; 222/326; 222/389

(58) Field of Classification Search
USPC ..... 222/149, 325, 334, 394, 399, 386.5, 6, 222/129, 94, 129.2, 80, 81, 66, 67, 82, 83, 222/83.5, 85, 86, 95, 105, 1
See application file for complete search history.

(56) References Cited

U.S. PATENT DOCUMENTS 1,522,975 A * 1/1925 Phillips ..... 222/82
2,564,163 A * 8/1951 Leperre ..... 141/2

(Continued)

FOREIGN PATENT DOCUMENTS

CA 2412480 5/2004
WO WO02/059035 8/2002

(Continued)

OTHER PUBLICATIONS

International Search Report on related PCT application (PCT/EP2009/061742); International Searching Authority (EPO) dated Jan. 22, 2010.

*Primary Examiner* — Kevin P Shaver
*Assistant Examiner* — Michael J Melaragno
(74) *Attorney, Agent, or Firm* — Klein, O'Neill & Singh, LLP

(57) ABSTRACT

A method and a system of cleaning and flushing a beverage dispensing system comprising a sealable pressure chamber for receiving a collapsible keg containing a beverage and a dispensing valve, comprises: providing a first cartridge containing a cleaning fluid, positioning the first cartridge in the pressure chamber and pressurizing the pressure chamber, opening the dispensing valve and dispensing the cleaning fluid from the dispensing valve, and causing the cleaning fluid to flow from the first cartridge through the dispensing line and being dispensed from the dispensing valve, disconnecting the first cartridge after the emptying of the cleaning fluid from the first cartridge, and removing the first cartridge, providing a second cartridge containing a flushing fluid, positioning the second cartridge in the pressure chamber and pressurizing the pressure chamber, and repeating the steps (iii)-(v) while using the second cartridge instead of the first cartridge.

11 Claims, 6 Drawing Sheets

(56) References Cited

U.S. PATENT DOCUMENTS

| | | | | | |
|---|---|---|---|---|---|
| 3,442,424 | A * | 5/1969 | Prussin et al. | 222/81 |
| 3,662,929 | A * | 5/1972 | Sims | 222/386.5 |
| 4,429,809 | A * | 2/1984 | Bousgarbies | 222/67 |
| 4,657,151 | A * | 4/1987 | Cabernoch | 215/11.6 |
| 5,060,826 | A * | 10/1991 | Coleman | 222/95 |
| 5,102,010 | A * | 4/1992 | Osgar et al. | 222/1 |
| 5,718,261 | A * | 2/1998 | Chen | 137/393 |
| 5,888,313 | A | 3/1999 | West | |
| 5,996,620 | A * | 12/1999 | Bensley | 137/554 |
| 6,364,103 | B1 * | 4/2002 | Sergio et al. | 206/222 |
| D567,474 | S * | 4/2008 | Rasmussen | D34/39 |
| 2010/0176149 | A1 * | 7/2010 | Rasmussen | 222/54 |
| 2012/0187153 | A1 * | 7/2012 | Burge et al. | 222/386.5 |

FOREIGN PATENT DOCUMENTS

| | | | |
|---|---|---|---|
| WO | WO2005/007559 | 1/2005 | |
| WO | WO2007/053665 | 5/2007 | |
| WO | WO2007/076584 | 7/2007 | |
| WO | WO 2007076584 A2 * | 7/2007 | B67D 1/08 |

* cited by examiner

30'''
62
64
66
68
24'''
70
28'
26'
25

62
64
66
68
28'
26'
25

72
74
76
24'''
68
28'
26'
25

72'
76
68
70
28'
26'
25

APPARATUS AND METHOD FOR CLEANING AND FLUSHING A BEVERAGE DISPENSING SYSTEM

CROSS-REFERENCE TO RELATED APPLICATION

This application is a national phase filing, under 35 U.S.C. §371(c), of International Application No. PCT/EP2009/061742, filed Sep. 10, 2009, the disclosure of which is incorporated herein by reference in its entirety.

FEDERALLY SPONSORED RESEARCH OR DEVELOPMENT

Not Applicable

BACKGROUND

Beverage dispensing systems are typically used in beverage dispensing establishments for efficiently dispensing large quantities of beverage. Typically, beverage dispensing systems are used to dispense carbonated alcoholic beverages such as draught beer and cider. However, also non-alcoholic beverages such as soda and non-carbonates beverage such as wine and fruit juice may be dispensed using a beverage dispensing system. Beverage dispensing systems are mostly for professional users such as in establishments like bars, restaurants and hotels, however, increasingly also for private users such as in private homes.

Professional beverage dispensing systems typically dispense beverage provided in large beverage kegs. Such beverage kegs may hold 20-50 liters of beverage for a professional beverage dispensing system for allowing typically 50-100 beverage dispensing operations before needing to exchange beverage keg. In the past, beverage kegs were made of solid materials such as steel and re-filled a number of times. In-between each filling the beverage kegs would have to be carefully cleaned, which has proven to be very costly. Insufficient cleaning may lead to unhygienic beverage kegs, which may in turn lead to health problems for the beverage consumer. More recent beverage kegs are made collapsible for single use only due to the above hygiene concern. An example of such a beverage dispensing system using collapsible beverage kegs is the DraughtMaster™ system provided by the applicant company. Such beverage dispensing systems using collapsible beverage kegs typically have the beverage keg installed in a pressure chamber. When dispensing beverage from the beverage dispensing system, a pressure fluid is allowed to enter the pressure chamber. When dispensing beverage from the beverage keg, the pressure fluid acts on the beverage keg and the beverage keg collapses. The volume of the beverage keg is reduced corresponding to the amount of dispensed beverage. The collapsible beverage kegs are preferably made of flexible and disposable material such as plastic.

When performing a dispensing operation the force of the pressure forces the beverage out of the beverage container and into a dispensing line. The dispensing line leads to a dispensing device typically having a dispensing valve and a handle for allowing an operator to control the dispensing valve. The operator, such as a bartender or barmaid, uses the dispensing device to control the rate of dispensing. After each beverage dispensing operation, some amount of residual beverage will inevitably be left in the dispensing line and in the dispensing device. After a certain amount of time a layer of residual beverage may be formed inside the dispensing line and dispensing device. Such layers of residual beverage may solidify and eventually clog the dispensing line and/or the dispensing device, which will interrupt the beverage dispensing operation. However, well before clogging the dispensing line and/or device, the residual beverage will pose a hygienic problem. The dispensing line and the dispensing device constitute areas where bacterial growth may be accelerated due to the presence of beverage, the large surface area in comparison to the beverage volume, the lack of sufficient cooling and the close proximity to the outside. Bacterial growth due to lack of hygiene in the dispensing line and the dispensing device may constitute a health problem for the beverage consumer. Therefore there is a need for technologies for cleaning the dispensing line and the dispensing device after a certain period of time or alternatively after a certain number of dispensing operations.

The above problem may for private users be solved by using a disposable dispensing line and dispensing device intended for single use only. For a professional user a single use dispensing line and dispensing device would mean that the operator would have to reinstall the dispensing line and dispensing device regularly, possibly several times a day. Frequent installation, which would require considerably more time, compared to having the dispensing line and dispensing device permanently installed in the establishment. Some establishments may have the pressure chamber in a different location, such as in the basement below the actual dispensing location, which would require even larger effort for changing the dispensing line. In such establishments the tapping device itself will typically be made of non-disposable materials for the reason of good appearance.

In published PCT application WO 2009/024147 claiming priority from European patent application 07388059.3 filed on the 20 Aug. 2007, a beverage distribution system having a separate rinsing line has been described. By using a specially designed dispensing valve, alternative rinsing fluid or beverage may enter the dispensing line. Rinsing fluid is provided from a separate pressurized reservoir. The dispensing valve includes safety features for avoiding mixing rinsing fluid and beverage. This solution to the above problem would, however, need additional investments and would not be suitable for already present establishments.

In WO 2007/076584A2 an automatic home multi beer dispensing apparatus is described. The above publication briefly describes that a cleaning cartridge may be used for cleaning the beverage dispensing apparatus. However, the publication does not describe any further details how the cleaning is performed.

SUMMARY

It is therefore an object of the present invention to provide technologies for cleaning and flushing a beverage dispensing system. Further objects of the present invention include providing technologies for cleaning and flushing a beverage dispensing system by using a cleaning and flushing cartridge.

When using a cleaning fluid to rinse the dispensing line and the dispensing device, it is important to ensure that the cleaning fluid is properly removed from the beverage distribution system before beginning beverage dispensing operations. It is therefore a further object of the present invention to provide technologies for removing rinsing fluid from a beverage dispensing system. A further object of the present invention is to provide a safety system for avoiding a beverage container to be installed without previously performing a flushing operation.

The above need and the above objects together with numerous other needs and objects, which will be evident from the below detailed description, are according to a first broad aspect of the present invention obtained by a method of cleaning and flushing a beverage dispensing system comprising a sealable pressure chamber for receiving a collapsible keg containing a beverage, the pressure chamber having a first connector, the collapsible keg having a second connector for cooperating with and sealing against the first connector, the beverage dispensing system further comprising a fluid pressure source connected to the pressure chamber for pressurising the pressure chamber, a dispensing line, a dispensing valve, and a dispensing device, the dispensing valve being included or accommodated in the dispensing device, the dispensing line defining a proximal end and a distal end, the proximal end being connected to the first connector and the distal end being connected to the dispensing valve, the dispensing valve having a closed and an open position, the open position allowing the beverage to be dispensed from the dispensing valve when the pressure chamber is pressurised, and the closed position preventing the beverage from being dispensed from the dispensing valve, the method comprising the following steps:

(i) providing a cleaning and flushing system comprising a first cartridge containing a cleaning fluid and a second cartridge containing a flushing fluid, (ii) positioning the cleaning and flushing system in the pressure chamber and pressurising the pressure chamber, and (iii) opening the dispensing valve and dispensing the cleaning fluid from the dispensing valve, and causing the cleaning fluid to flow from the first cartridge past the first connector through the dispensing line and being dispensed from the dispensing valve, and subsequently dispensing the flushing fluid from the dispensing valve, and causing the flushing fluid to flow from the second cartridge past the first connector through the dispensing line and being dispensed from the dispensing valve.

(iv) removing the cleaning and flushing system after the emptying of the flushing fluid from the second cartridge.

The cleaning and flushing system may be installed in a similar way as the beverage keg into the pressure chamber. The cleaning and flushing system is preferably made reusable and refillable by the user and it may preferably be made of metal. Alternatively, the cleaning and flushing system is made collapsible for single use only. The first and second cartridges, containing the cleaning and flushing fluid respectively, may typically be made significantly smaller than the beverage keg, since the typically needed volume of cleaning and flushing fluid is less than the volume that the typical beverage keg may hold. The first cartridge containing the cleaning fluid is preferably marked to distinguish it from the second cartridge containing the flushing fluid. Such markings may include a yellow and black ribbon, which constitutes a warning indicator.

The cleaning fluid should be chosen among fluids being efficient for removing solid or liquid residual beverage in the dispensing line or in the tapping device. Preferably the cleaning fluid has no toxic or low toxic properties to avoid any health risks. Additionally, the cleaning fluid preferably has no or low corrosive properties to avoid any damage or excessive wear on the beverage dispensing system. The cleaning fluid is preferably dyed to distinguish it from the flushing fluid. The cleaning fluid may also be dyed in a color to distinguish it from the dispensed beverage, e.g. when dispensing beer, which has a yellowish color, the dye may preferably be any of the colors red, green or blue such that it may be visually observed when the cleaning fluid is dispensed. Suitable cleaning fluids may include alcohol, soap, alkali or sour chemicals or the like.

The method according to the first aspect of the present invention is preferably employed in connection with the exchange of the beverage keg, i.e. after removing an empty beverage keg and before installing a new beverage keg. In some circumstances it may be necessary to clean in-between changing the beverage keg, e.g. if a long period of time has passed since the last cleaning. The cleaning and flushing system is installed in the pressure chamber similarly to a beverage keg. When the pressure chamber is sealed and pressure fluid is introduced, the rinsing fluid is forced out of the cartridge and pressure chamber. The pressure fluid may preferably be any gas such as e.g. pressurized air. The pressure source may be e.g. a compressor. If using a membrane between the cleaning and flushing system and the pressure fluid, a liquid pressure fluid such as water may be used as an alternative to a gaseous pressure fluid. The membrane prevents the cleaning fluid from mixing with the pressure fluid. The membrane may e.g. constitute a collapsible cartridge or a liner.

The pressure fluid may preferably act directly on the cleaning fluid such that when the dispensing valve is opened the cleaning fluid is propelled via the dispensing line and the dispensing device to the outside. The cleaning fluid cleans and rinses the dispensing line and the dispensing valve while passing through the beverage dispensing system. After leaving the dispensing device, the cleaning fluid may flow into a drain system, which is typically provided below the dispensing device for collecting beverage which has been excessively dispensed. If a highly toxic cleaning fluid is used, it may be required to collect it separately for proper disposal.

To ensure no cleaning fluid remains inside the beverage dispensing system, the dispensing line and the dispensing valve must be flushed by introducing a flushing fluid before beverage dispensing operations may begin. The flushing fluid should be cheap, non-toxic, and neutral in taste. Preferably pure water is used as flushing fluid. The flushing fluid is introduced from the second cartridge into the dispensing line after the first cartridge has been emptied.

The flushing fluid is propelled via the dispensing line and the dispensing device to the outside. The flushing fluid is preferably transparent for an operator to be able to visually detect any traces of cleaning fluid remaining inside the beverage dispensing system. By the end of the flushing, only flushing fluid should appear at the dispensing device. If cleaning fluid still appears at the end of the flushing, the flushing is preferably resumed until the cleaning fluid is completely removed from the beverage dispensing system. The cleaning fluid may otherwise influence the taste of the beverage and possibly be unhealthy to the beverage consumer. When the flushing is concluded, the cleaning and flushing system may be removed and a beverage keg may be installed.

Alternatively, the cleaning fluid and/or the flushing fluid may comprise a gas, such a steam. When using a gaseous cleaning fluid, the first and/or second cartridge may be pressurized.

The above need and the above object together with numerous other needs and objects, which will be evident from the below detailed description, are according to a second aspect of the present invention obtained by a method of cleaning and flushing a beverage dispensing system comprising a sealable pressure chamber for receiving a collapsible keg containing a beverage, the pressure chamber having a first connector, the collapsible keg having a second connector for cooperating with and sealing against the first connector, the beverage dispensing system further comprising a fluid pressure source connected to the pressure chamber for pressurising the pressure chamber, a dispensing line, a dispensing valve, and a dispensing device, the dispensing valve being included or accommodated in the dispensing device, the dispensing line defining a proximal end and a distal end, the proximal end being connected to the first connector and the distal end being connected to the dispensing valve, the dispensing valve having a closed and an open position, the open position allowing the beverage to be dispensed from the dispensing valve when the pressure chamber is pressurised, and the closed position preventing the beverage from being dispensed from the dispensing valve, the method comprising the following steps:

(i) providing a first cartridge containing a cleaning fluid, (ii) positioning the first cartridge in the pressure chamber and connecting the first cartridge to the first connector, and pressurising the pressure chamber, (iii) opening the dispensing valve and dispensing the cleaning fluid from the dispensing valve, and causing the cleaning fluid to flow from the first cartridge past the first connector through the dispensing line and being dispensed from the dispensing valve, (iv) disconnecting the first cartridge from the first connector after the emptying of the cleaning fluid from the first cartridge, and removing the first cartridge, (v) providing a second cartridge containing a flushing fluid, (vi) positioning the second cartridge in the pressure chamber and connecting the second cartridge to the first connector, and pressurising the pressure chamber, (vii) opening the dispensing valve and dispensing the flushing fluid from the dispensing valve, and causing the flushing fluid to flow from the second cartridge past the first connector through the dispensing line and being dispensed from the dispensing valve, and (viii) disconnecting the second cartridge from the first connector after the emptying of the cleaning fluid from the second cartridge, and removing the second cartridge.

As an alternative to a cleaning and rinsing system two separate cartridges may be used where the first cartridge contains cleaning fluid and the second cartridge contains flushing fluid. The cartridges may have the same properties as described above in connection with the first aspect of the present invention. The first cartridge is introduced into the pressure chamber after the pressure chamber has been depressurized and the beverage container has been removed. The cleaning fluid may enter the dispensing line when the pressure chamber has been re-pressurized and the dispensing device, i.e. the dispensing valve, has been opened.

When the cleaning fluid has passed through the beverage dispensing system, i.e. when the first cartridge is empty, the pressure fluid may be removed from the pressure chamber and the empty first cartridge may be removed. The second cartridge containing the flushing fluid may be installed and emptied in the same way as the first cartridge to flush the beverage dispensing system.

Both the first and second cartridges should each have an outlet connector, which should be put in fluid communication with the first connector of the pressure chamber such that the outlet connector is sealed to the first connector. The outlet connector of the cartridge and the first connector of the pressure chamber are preferably placed at the bottom end of the cartridge and pressure chamber, respectively. The pressure fluid may preferably be allowed to interact with the cleaning and flushing fluid at a fluid to fluid surface located at an opposite top end of the cartridge ensuring the cleaning and flushing cartridges to be empty before pressure fluid enters the dispensing line. Alternatively, a collapsible cartridge may be used as discussed above.

In the method according to the second aspect of the present invention it is important that the first and second cartridges are not mixed up. If the first and second cartridge would be mixed up, i.e. if cleaning fluid would be introduced into the beverage dispensing system after the flushing, cleaning fluid would still be present in the beverage dispensing system when the beverage dispensing operations are initiated. This constitutes a problem since cleaning fluid may contaminate the beverage and cause the beverage to have an undesirable taste. In some cases the cleaning fluid may also be hazardous to the health of the beverage consumer.

In some embodiments according to the second aspect of the present invention the above problem may be avoided by providing a marker to guide the operator to follow the correct installation procedure. The first cartridge may be marked as such by e.g. dyeing the fluid and/or placing a ribbon on the outside of the cartridge. The second cartridge may have corresponding markings. The beverage dispensing system may also have markings, such as an information plate fixated to the pressure chamber to make the operator aware of the risk of mixing up the cartridges.

In a further embodiment according to the second aspect of the present invention the first cartridge comprises a third connector cooperating with and sealing against the first connector, the third connector comprising a detachable element being separated from the first cartridge and being left on and/or locked to the first connector when removing the first cartridge from the pressure chamber, the second cartridge comprising a fourth connector sealing against the first connector and/or the detachable element and catching the detachable element for removing the detachable element from the first connector when removing the second cartridge.

The third connector constitutes a physical barrier making any mix up between the first cartridge containing cleaning fluid and the second cartridge containing flushing fluid impracticable. The third connector, which is designed to remain fixated to the first connector, will prevent any beverage container to be installed. It will also prevent any further first cartridge to be installed, which would not be harmful but would constitute a wasteful double cleaning. The only way of removing the third connector is by installing a second cartridge containing flushing fluid. The second cartridge will fit to the third connector and when the second cartridge is removed, the third connector will be removed as well.

The above need and the above object together with numerous other needs and objects, which will be evident from the below detailed description, are according to a third aspect of the present invention obtained by a method of cleaning and flushing a beverage dispensing system comprising a sealable pressure chamber for receiving a collapsible keg containing a beverage, the pressure chamber having a first connector, the collapsible keg having a second connector for cooperating with and sealing against the first connector, the beverage dispensing system further comprising a fluid pressure source connected to the pressure chamber for pressurising the pressure chamber, a dispensing line, a dispensing valve, and a dispensing device, the dispensing valve being included or accommodated in the dispensing device, the dispensing line defining a proximal end and a distal end, the proximal end being connected to the first connector and the distal end being connected to the dispensing valve, the dispensing valve having a closed and an open position, the open position allowing the beverage to be dispensed from the dispensing valve when the pressure chamber is pressurised, and the closed position preventing the beverage from being dispensed from the dispensing valve, the method comprising the following steps:

(i) providing a multi-chambered cartridge comprising a first cartridge containing a cleaning fluid and a second cartridge containing a flushing fluid, (ii) positioning the multi-chambered cartridge in the pressure chamber and connecting the multi-chambered cartridge to the first connector, and pressurising the pressure chamber by means of a pressure fluid, and (iii) opening the dispensing valve and dispensing the cleaning fluid from the dispensing valve, and causing the cleaning fluid to flow from the first cartridge past the first connector through the dispensing line and being dispensed from the dispensing valve, and sequentially dispensing the flushing fluid from the dispensing valve, and causing the flushing fluid to flow from the second cartridge past the first connector through the dispensing line and being dispensed from the dispensing valve.

(iv) disconnecting the multi-chambered cartridge from the first connector after the emptying of the cleaning and flushing fluids from the multi-chambered cartridge, and removing the multi-chambered cartridge.

By providing a multi-chambered cartridge comprising a separate first and second cartridge a mix up between the first and second cartridge may be avoided. The first and second cartridges may preferably have the same properties as discussed above in connection with the first and second aspect of the present invention. The first and second cartridge of the multi-chambered cartridge should be configured to allow the first cartridge to be emptied before allowing the second cartridge to be emptied. This may be achieved by providing a controlling valve for switching between the first and second cartridges. The controlling valve may comprise a 3-way valve being operated either manually or automatically.

In a further embodiment according to the third aspect of the present invention, the multi-chambered cartridge comprises a fluid inlet coupled to the second cartridge for establishing fluid communication from the pressure chamber to the second cartridge and allowing a pressure in the pressure chamber to be conveyed to the second cartridge, a cartridge connection connecting the first and second cartridges for establishing fluid communication from the second cartridge to the first cartridge and a pressure in the second cartridge to be conveyed to the first cartridge, and a fifth connector connected to the first cartridge for cooperating with and sealing against the first connector.

By providing fluid communication between the first and second cartridge the flushing may start automatically when the cleaning is finished. The pressure fluid may thus act on the flushing fluid, which in turn acts on the rinsing fluid propelling the rinsing fluid via the fifth connector into the dispensing line and through the dispensing device. When the rinsing fluid has been dispensed, the flushing fluid, which has then advanced into the first cartridge, will be allowed to flow into the fifth connector and further through the dispensing line to the dispensing device.

The above configuration eliminates the need of any valve. In some variants the mixing of cleaning fluid and flushing fluid may be avoided by using fluids of substantially different density or otherwise fluids, which do not generally mix well. Additionally, the cartridge connection may be small to avoid accidental mixing of cleaning fluid and flushing fluid.

In a further embodiment according to the third aspect of the present invention, the multi-chambered cartridge defines an emptying position for dispensing the cleaning and flushing fluids, in which emptying position the first cartridge defines a first upper and a first lower end, and the second cartridge defines a second upper and a second lower end, the fluid inlet being located at the second upper end of the second cartridge, the cartridge connection being connected to the second cartridge at its second lower end and to the first cartridge at its first upper end, and the fifth connector being connected to the first cartridge at its first lower end.

The emptying position is understood to mean the position when the multi-chambered cartridge is installed in the pressure chamber and ready for use. The first and second cartridge is oriented such that the pressure fluid acts on the upper end surface of the flushing fluid in the second cartridge and allowing the flushing fluid to exit at the lower end of the second cartridge. The flushing fluid is lead to the upper end of the first cartridge for acting onto the upper end surface of the cleaning fluid. Thereby the cleaning fluid is propelled towards the dispensing line via the fifth connector, which is positioned at the bottom end of the first cartridge.

In a further embodiment according to the third aspect of the present invention, the fluid pressure source generates pressurized gas when pressurising the pressure chamber, the first cartridge of the multi-chambered cartridge further comprising a float valve located at its first lower end and preventing the pressurized gas from entering the dispensing line after emptying the cleaning and flushing fluids from the multi-chambered cartridge.

Typically, when the cleaning and flushing fluid has exited the first and second cartridge, pressure fluid will enter the dispensing line. The pressure fluid, being typically high-pressurized gas, will exit through the dispensing device with a high velocity, which may cause damage and possibly personal injury. Providing a float valve comprising a valve element having a density lower than the cleaning and flushing fluids but higher than the pressure fluid will prevent the pressure fluid from entering the dispensing line after the cleaning and flushing fluids have left the first and second cartridges.

In a further embodiment according to the third aspect of the present invention, the multi-chambered cartridge is collapsible and further comprises a sixth connector connected to the first cartridge for cooperating with and sealing against the first connector, a partition separating the first and second cartridges prior to the dispensing of the cleaning fluid, the multi-chambered cartridge further comprising a piercing element for creating an opening in the partition at the completion of the emptying of the cleaning fluid, thereby enabling the subsequent dispensing of the flushing fluid through the opening and the sixth connector.

The collapsible multi-chambered cartridge may preferably be made of a flexible plastic material. By having the first cartridge containing cleaning fluid in fluid communication with the first and sixth connector it is ensured that rinsing fluid will first flow into the dispensing line when the pressure fluid is applied. The second cartridge is located outside the first cartridge being separated from the first cartridge by a partition typically constituting a thin plastic wall. When the rinsing fluid has flown out of the first cartridge, the partition between the first cartridge and the second cartridge will collapse onto the sixth connector and pierce the partition wall allowing the flushing fluid to leave the second cartridge through the sixth connector towards the dispensing device. The first cartridge should be collapsible whereas the second cartridge must only be collapsible in the parts constituting the partition between the first cartridge and the second cartridge if pressure fluid is allowed to enter the second cartridge. The second cartridge is preferably collapsible, however, it is preferably not pierceable by the sixth connector.

In a further embodiment according to the third aspect of the present invention, the multi-chambered cartridge defines an emptying position for dispensing the cleaning and flushing fluids, and prior to the dispensing of the cleaning fluid the volume of the cleaning fluid defining a first centre-of-gravity, the volume of the flushing fluid defining a second centre-of-gravity, and when the multi-chambered cartridge being in the emptying position the first centre-of-gravity is located below the second center-of-gravity.

When using the above collapsible multi-chambered cartridges the centre-of-gravity of the cleaning fluid may be placed below the centre-of-gravity of the flushing fluid. This implies that the centre-of-gravity of the cleaning fluid is located closer to the sixth connector than the centre-of-gravity of the flushing fluid. The above placement is advantageous since it will ensure that all cleaning fluid will exit towards the dispensing line before the partition is pierced.

In a further embodiment according to the third aspect of the present invention the first cartridge defines a first volume and a first direction, along which the cross-section of the first volume is substantially constant, the multi-chambered cartridge further comprising a first piston sealing against the first cartridge and dividing the cleaning fluid from the pressure chamber, the first piston allowing a pressure in the pressure chamber to be conveyed to the first cartridge, a seventh connector connected to the first cartridge for cooperating and sealing against the first connector, a flushing-fluid valve connected to the first and second cartridges and having a closed and an open position, the flushing-fluid valve being in its closed position when dispensing the cleaning fluid and the first piston moves along the first direction, and the first piston changing the flushing-fluid valve at the completion of the emptying of the cleaning fluid from its closed to its open position for allowing the flushing fluid to be dispensed through the flushing fluid valve and the seventh connector.

The flushing fluid valve will prevent any mixing of the cleaning fluid in the first cartridge and the flushing fluid in the second cartridge. When pressurizing the pressure chamber the pressure fluid may apply a force on both the flushing fluid directly and the cleaning fluid via the piston. The piston is typically located opposite the first and seventh connector such that when the dispensing valve is opened, the piston propagates towards the first and seventh connector and allows the cleaning fluid to leave through the first connector and the dispensing line. The flushing fluid is prevented to leave through the seventh and first connector until the piston acts to open the flushing fluid valve when the first cartridge has been emptied. The cleaning fluid is then automatically released and may flow through the dispensing line. When the piston has acted to open the flushing fluid valve, the flushing fluid may flow out from the seventh connector via the first connector towards the dispensing line and dispensing device. After the flushing fluid has exited the multi-chambered cartridge, the pressure chamber may be depressurized, the multi-chambered cartridge may be removed and the piston and flushing fluid valve may be restored to their initial positions.

In a further embodiment according to the third aspect of the present invention, the second cartridge defines a second volume and a second direction, along which the cross-section of the second volume is substantially constant, the multi-chambered cartridge further comprising a second piston sealing against the second cartridge and dividing the flushing fluid from the pressure chamber, the second piston allowing a pressure in the pressure chamber to be conveyed to the second cartridge, and the second piston moving along the first direction when dispensing the flushing fluid.

To prevent any pressure fluid to exit through the seventh connector, and further through the first connector, the dispensing line and the dispensing device the second cartridge may be provided with a second piston. The pressure fluid will act on the second piston in the second cartridge, which will act on the flushing fluid. The second piston is preferably located opposite the first and the seventh connector as well. When the first piston has reached the flushing fluid valve and the flushing fluid is allowed to exit through the seventh and first connector, the second piston will propagate towards the seventh connector. When the second piston reaches the seventh connector the flushing fluid has exited through the first connector and the second piston will stop and prevent any pressure fluid to exit through the second connector. The present embodiment is preferably used in connection with a liquid pressure fluid to prevent mixing of pressure fluid and flushing fluid/cleaning fluid.

The above need and the above object together with numerous other needs and objects, which will be evident from the below detailed description, are according to a broad fourth aspect of the present invention obtained by a cleaning and flushing system for a beverage dispensing system comprising a sealable pressure chamber for receiving a collapsible keg containing a beverage, the pressure chamber having a first connector, the collapsible keg having a second connector for cooperating with and sealing against the first connector, the beverage dispensing system further comprising a fluid pressure source connected to the pressure chamber for pressurising the pressure chamber, a dispensing line, a dispensing valve, and a dispensing device, the dispensing valve being included or accommodated in the dispensing device, the dispensing line defining a proximal end and a distal end, the proximal end being connected to the first connector and the distal end being connected to the dispensing valve, the dispensing valve having a closed and an open position, the open position allowing the beverage to be dispensed from the dispensing valve when the pressure chamber is pressurised, and the closed position preventing the beverage from being dispensed from the dispensing valve, the cleaning and flushing system further comprising a first cartridge containing a cleaning fluid and a second cartridge containing a flushing fluid for being positioned in the pressure chamber when pressurising the pressure chamber, and opening the dispensing valve and dispensing the cleaning fluid from the dispensing valve, and causing the cleaning fluid to flow from the first cartridge past the first connector through the dispensing line and being dispensed from the dispensing valve, and subsequently dispensing the flushing fluid from the dispensing valve, and causing the flushing fluid to flow from the second cartridge past the first connector through the dispensing line and being dispensed from the dispensing valve.

The cleaning and flushing system according to the broad fourth aspect of the present invention corresponds to the method according to the broad first aspect of the present invention.

The above need and the above object together with numerous other needs and objects, which will be evident from the below detailed description, are according to a fifth aspect of the present invention obtained by a cleaning and flushing system for a beverage dispensing system comprising a sealable pressure chamber for receiving a collapsible keg containing a beverage, the pressure chamber having a first connector, the collapsible keg having a second connector for cooperating with and sealing against the first connector, the beverage dispensing system further comprising a fluid pressure source connected to the pressure chamber for pressurising the pressure chamber, a dispensing line, a dispensing valve, and a dispensing device, the dispensing valve being included or accommodated in the dispensing device, the dispensing line defining a proximal end and a distal end, the proximal end being connected to the first connector and the distal end being connected to the dispensing valve, the dispensing valve having a closed and an open position, the open position allowing the beverage to be dispensed from the dispensing valve when the pressure chamber is pressurised, and the closed position preventing the beverage from being dispensed from the dispensing valve, the cleaning and flushing system further comprising:

(i) first cartridge containing a cleaning fluid for being positioned in the pressure chamber when pressurising the pressure chamber, and opening the dispensing valve and dispensing the cleaning fluid from the dispensing valve, and causing the cleaning fluid to flow from the first cartridge past the first connector through the dispensing line and being dispensed from the dispensing valve, and for being removed after the emptying of the cleaning fluid from the first cartridge, (ii) a second cartridge containing a flushing fluid for being positioned in the pressure chamber and pressurising the pressure chamber, and opening the dispensing valve and dispensing the flushing fluid from the dispensing valve, and causing the flushing fluid to flow from the second cartridge past the first connector through the dispensing line and being dispensed from the dispensing valve, and for being removed after the emptying of the flushing fluid from the second cartridge.

The cleaning and flushing system according to the fifth aspect of the present invention corresponds to the method according to the second aspect of the present invention and any of the features mentioned above in relation to the second aspect of the present invention applies equally on the cleaning and flushing system according to the fifth aspect of the present invention.

The above need and the above object together with numerous other needs and objects, which will be evident from the below detailed description, are according to a sixth aspect of the present invention obtained by a cleaning and flushing system for a beverage dispensing system comprising a sealable pressure chamber for receiving a collapsible keg containing a beverage, the pressure chamber having a first connector, the collapsible keg having a second connector for cooperating with and sealing against the first connector, the beverage dispensing system further comprising a fluid pressure source connected to the pressure chamber for pressurising the pressure chamber, a dispensing line, a dispensing valve, and a dispensing device, the dispensing valve being included or accommodated in the dispensing device, the dispensing line defining a proximal end and a distal end, the proximal end being connected to the first connector and the distal end being connected to the dispensing valve, the dispensing valve having a closed and an open position, the open position allowing the beverage to be dispensed from the dispensing valve when the pressure chamber is pressurised, and the closed position preventing the beverage from being dispensed from the dispensing valve, the cleaning and flushing system further comprising a multi-chambered cartridge comprising a first cartridge containing a cleaning fluid and a second cartridge containing a flushing fluid for being positioned in the pressure chamber when pressurising the pressure chamber, and opening the dispensing valve and dispensing the cleaning fluid from the dispensing valve, and causing the cleaning fluid to flow from the first cartridge past the first connector through the dispensing line and being dispensed from the dispensing valve, and subsequently dispensing the flushing fluid from the dispensing valve, and causing the flushing fluid to flow from the second cartridge past the first connector through the dispensing line and being dispensed from the dispensing valve.

The cleaning and flushing system according to the sixth aspect of the present invention corresponds to the method according to the third aspect of the present invention and any of the features mentioned above in relation to the third aspect of the present invention applies equally on the cleaning and flushing system according to the sixth aspect of the present invention.

It is further to be contemplated that for instance the float valve used in connection with the third aspect of the present invention may be used in any of the embodiments of the second aspect of the present invention. A lid may be used to seal the cartridges inside the pressure chamber, however when using a lid at least one pressure inlet is required to allow pressure fluid to enter and apply a force onto the cleaning and flushing fluids.

BRIEF DESCRIPTION OF THE DRAWINGS

The present invention is now to be described in greater detail with reference to the drawings, wherein.

DETAILED DESCRIPTION

A detailed description of the figures of a presently preferred embodiment of the present invention follows below.

Figure 1:
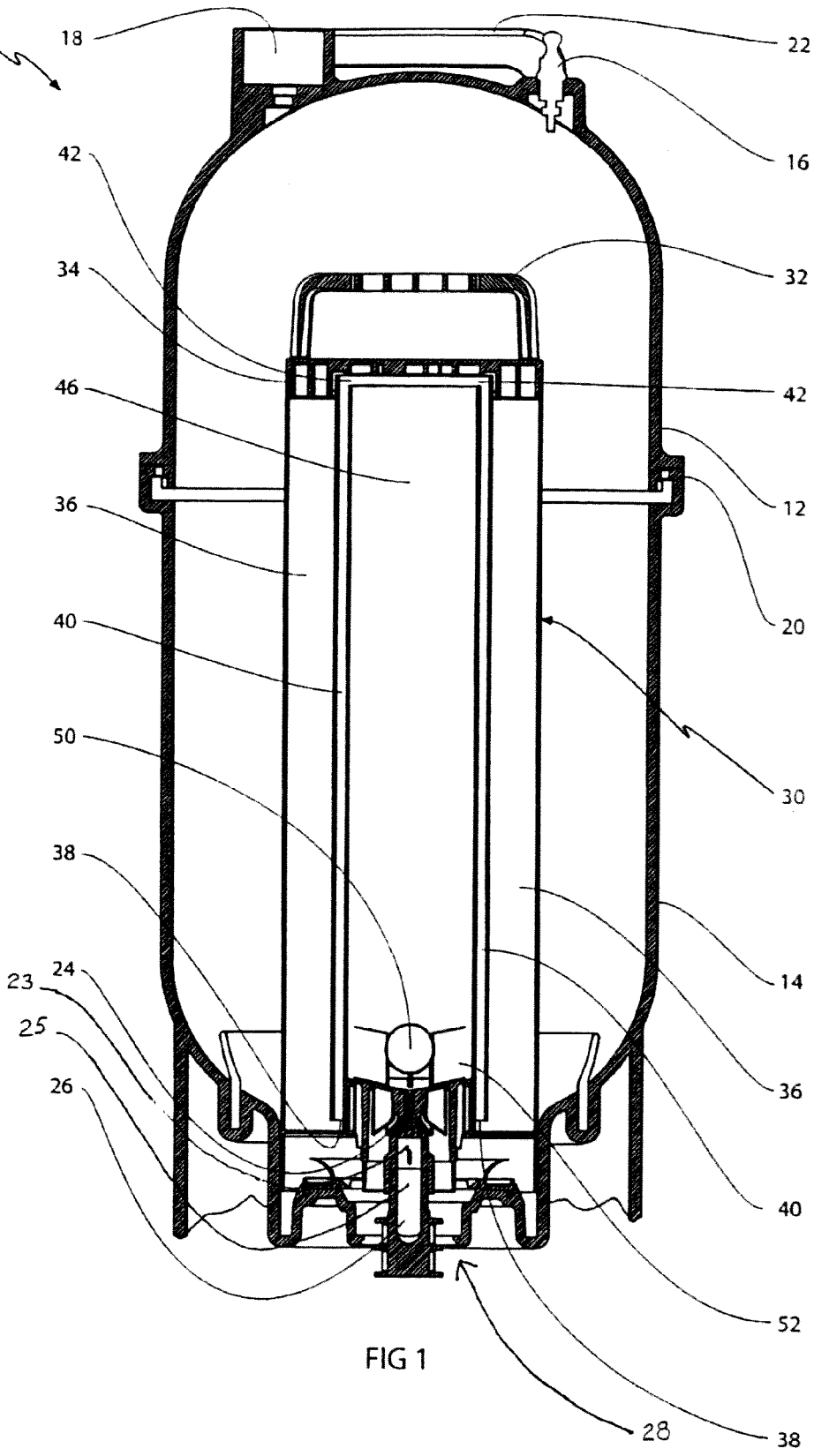
FIG. 1 is a cross-sectional view of a pressure chamber having an installed cleaning and flushing cartridge.

FIG. 1 is a pressure chamber 10 for use with a collapsible beverage keg. The collapsible beverage keg is not shown in the figure but well known in the art per se. The pressure chamber 10 comprises an upper part constituting a pressure lid 12 and a lower part constituting a receptacle 14. The pressure lid 12 has a pressure fluid intake 18 for supplying pressure fluid to the pressure chamber 10. The pressure fluid is supplied from a pressure source such as a compressor (not shown) and is preferably a pressurized gas such as compressed air, carbon dioxide or the like. The pressure lid 12 is further provided with a safety valve 16. The safety valve 16 may be set to a specific pressure corresponding to the maximum pressure allowed in the pressure chamber 10. Typically, the maximum pressure is around 3 bar. A seal 20 seals the contact surface between the pressure lid 12 and the receptacle 14.

For accessing the interior of the pressure chamber 10, the pressure lid 12 may be removed from the receptacle 14. For allowing a simple removal of the pressure lid 12, a handle 22 is provided on the pressure lid 12. The bottom of the receptacle 14 includes a pressure chamber outlet 23 that communicates between a beverage outlet 24 and a dispensing valve 26 for allowing fluid communication between the interior of the pressure chamber 10 and the outside.

The dispensing valve 26 may be further connected to a dispensing line 25 and a dispensing device 28 for allowing beverage dispensing at a different location than the location of the pressure chamber 10.

The pressure chamber 10 is shown in FIG. 1 having an installed cleaning and flushing system 30. The cleaning and flushing system 30 is made non-compressible and preferably of a metal such as aluminium or alternatively of a hard plastic material. The cleaning and flushing system 30 is made as an elongated and cylindrical body having a lower part in fluid communication with the beverage outlet 24 and an upper part being sealed from the rest of the pressure chamber 10 by a cartridge lid 34. The cartridge lid 34 has a handle 32 for simplifying the removal and the installation of the cleaning and flushing system 30.

The cleaning and flushing system 30 comprises an outer chamber constituting a flushing fluid cartridge 36 and an inner chamber constituting a cleaning fluid cartridge 46. The flushing fluid cartridge 36 is in fluid communication with the cleaning fluid cartridge 46 via a cartridge interconnection 40, which interconnects the lower part of the flushing fluid cartridge 36 and the upper part of the cleaning fluid cartridge 46. Flushing fluid may flow into the cartridge interconnection 40 at a flushing fluid outlet 38 located at the bottom of the flushing fluid cartridge 36 and flow out of the cartridge interconnection 40 and into the cleaning fluid cartridge 46 via a flushing fluid inlet 42 located at the top of the cleaning fluid cartridge 46.

A float valve 50 is provided at the bottom of the cleaning fluid cartridge 46 for controlling the outflow of fluid from the cleaning fluid cartridge 46 into the beverage outlet 24. The float valve 50 will permit liquids, i.e. flushing and cleaning fluid, to flow out through the beverage outlet 24 and prevent gas, i.e. pressure fluid from flowing out through the beverage outlet 24. A set of flanges constituting a float valve support 52 will ensure that the float valve 50 is positioned in a secure closed state in the cleaning fluid cartridge 46 when no cleaning fluid is present in the cleaning fluid cartridge 46.

Figure 2:
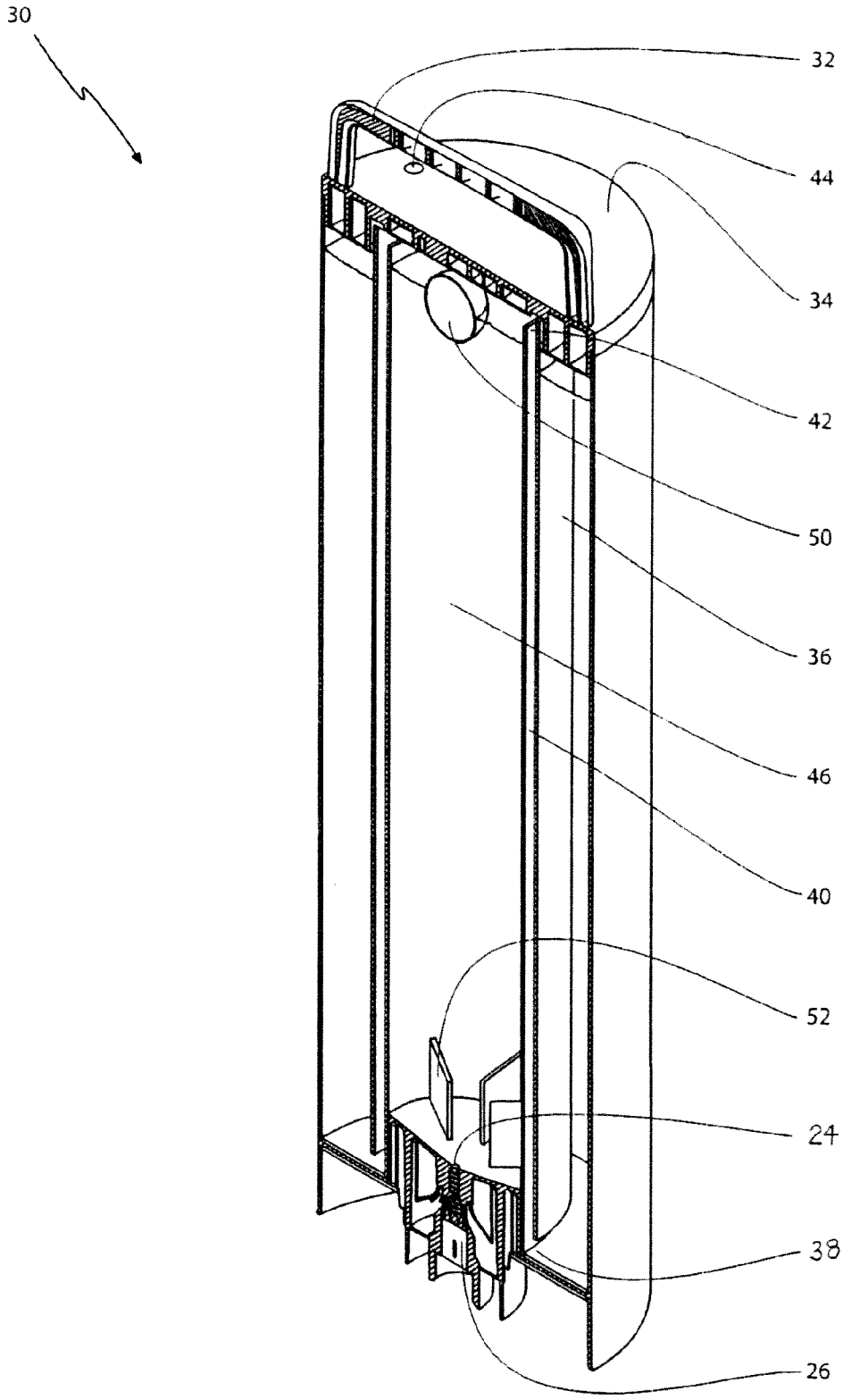
FIG. 2 is cross-sectional view of a cleaning and flushing cartridge having a float valve.

FIG. 2 illustrates the cleaning and flushing system 30 of FIG. 1. By removing the cartridge lid 34, the cleaning fluid cartridge 46 and the flushing fluid cartridge 36 may be filled with cleaning fluid and flushing fluid, respectively. After filling the respective cartridges 46, 36 the cartridge lid 34 may be replaced on the cleaning and flushing system 30. The cartridge lid 34 seals the cleaning fluid cartridge 46 from the pressure chamber 10 shown in FIG. 1. The cartridge lid 34 allows fluid communication between the pressure chamber 10 and the upper part of the flushing fluid cartridge 36 via a pressure fluid inlet 44. Thus, when a filled cleaning and flushing system 30 is installed in the pressure chamber 10, and the cartridge lid 34 is replaced and the pressure chamber 10 is pressurized by introducing pressure fluid through the pressure fluid intake 18 as shown in FIG. 1, the pressure fluid will act on the flushing fluid in the flushing fluid cartridge 36. The flushing fluid will in turn act on the cleaning fluid in the cleaning fluid cartridge 46 via the cartridge interconnection 40. By opening the dispensing valve 26, cleaning fluid will exit the cleaning fluid cartridge 46 through the beverage outlet 24. Flushing fluid will in turn enter the cartridge interconnection 40 via the flushing fluid outlet 38 and flow into the cleaning fluid cartridge 46 via the flushing fluid inlet 42. Pressure fluid will enter through the pressure fluid inlet 44 into the flushing fluid cartridge 36.

When all of the cleaning fluid has left the cleaning fluid cartridge 46, the cleaning fluid cartridge will be filled with flushing fluid from the flushing fluid cartridge 36. Consequently, pressure fluid of the same volume as the cleaning fluid will have entered the flushing fluid cartridge 36 and taken the place of the flushing fluid which has entered the cleaning fluid cartridge 46.

Subsequently, the flushing fluid is forced out the cleaning fluid cartridge 46 at the beverage outlet 24. The float valve 50 is made of a light material which may float on top of the cleaning and flushing fluid present in the cleaning fluid cartridge. The float valve 50 should have a higher specific density than the pressure fluid such that when the pressure fluid enters the cleaning fluid cartridge 46, the float valve 50 remains on the top of the cleaning and rinsing fluids. When all of the cleaning and rinsing fluids have left the cleaning fluid cartridge 46, the float valve will be positioned at the bottom of the cleaning fluid cartridge 46 and seal the beverage outlet 24 such that no pressure fluid may escape through the beverage outlet 24, as shown in FIG. 1.

The float valve support 52 ensures a correct positioning of the float valve 50 when the float valve approaches the beverage outlet 24 and when the float valve seals against the beverage outlet 24. Allowing pressure fluid to leave the pressure chamber and flow to the outside is wasteful and may damage equipment or cause personal injuries due to the very high pressure inside the pressure chamber 10. Also, a loss of pressure fluid may overload or empty the pressure source causing interruption in the beverage dispensing.

Figure 3A:
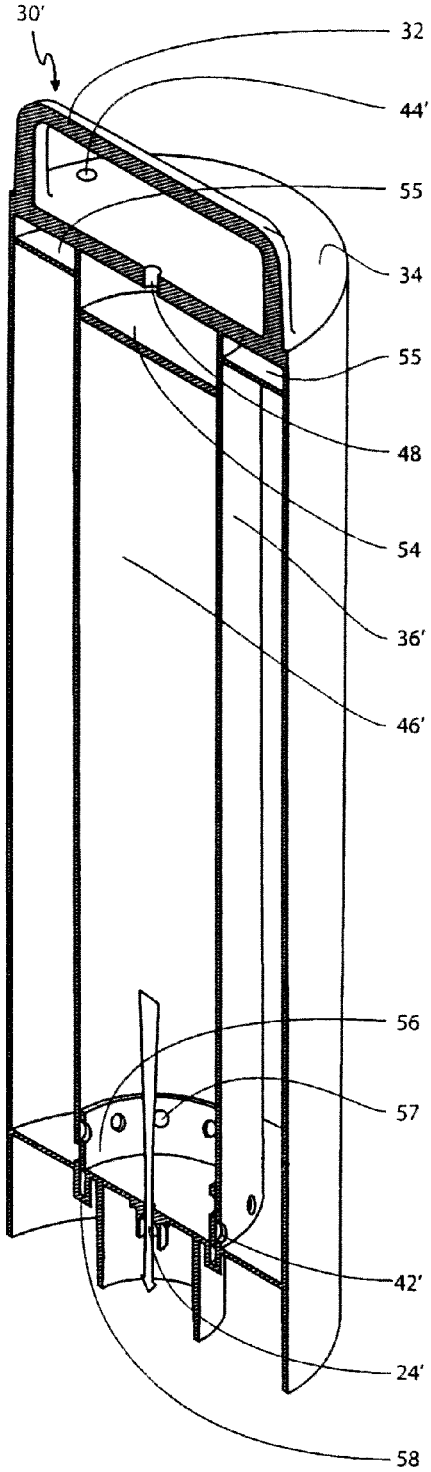
FIGS. 3A and 3B are cross-sectional views of a cleaning and flushing cartridge having a piston.
Figure 3B:
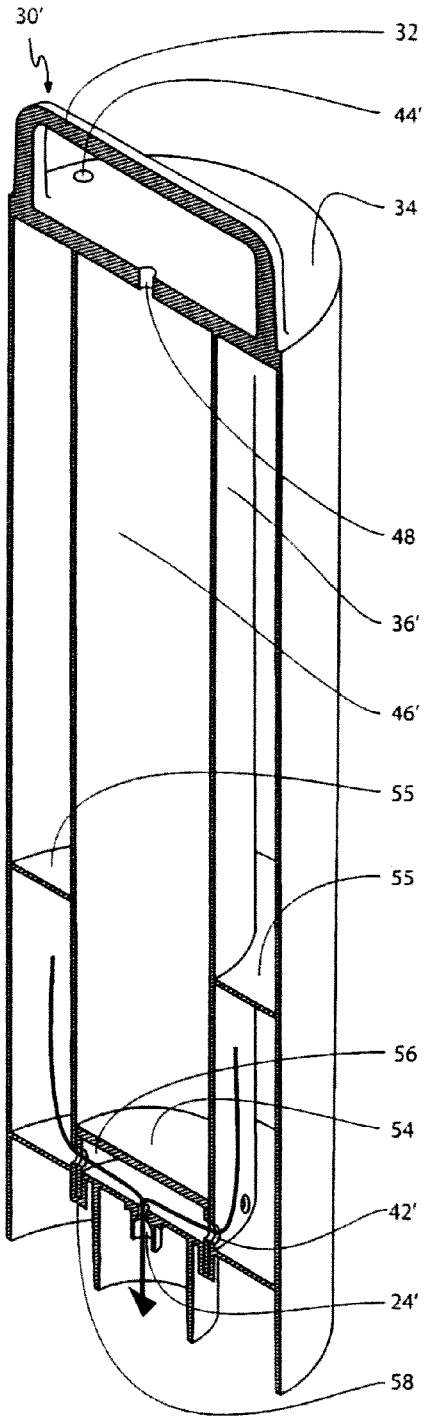

FIGS. 3A and 3B illustrate a further embodiment of the cleaning and flushing system 30' according to the present invention. The cleaning and flushing system 30' comprises an outer flushing fluid cartridge 36' and an inner cleaning fluid cartridge 46' similar to the first embodiment of the present invention as described in connection with FIG. 1 and FIG. 2.

In addition to the pressure fluid inlet 44', which provides fluid communication between the pressure chamber 10 shown in FIG. 1 and the top of the flushing fluid cartridge 36', the cartridge lid 34 has an auxiliary pressure fluid inlet 48 providing fluid communication between the pressure chamber 10 and the top of the cleaning fluid cartridge 46'. The cleaning fluid cartridge 46' and the flushing fluid cartridge 36' are divided into a respective upper space and lower space by an inner piston 54 and an outer piston 55 respectively. The respective cleaning and flushing fluids are accommodated in the respective lower spaces below the respective inner and outer piston 54, 55.

Pressure fluid is allowed to enter the upper space of the cleaning fluid cartridge 46' and act on the inner piston 54 which in turn acts to press out the cleaning fluid through the beverage outlet 24'. The lower spaces of the flushing fluid cartridge 36' and the cleaning fluid cartridge 46' are interconnected by a flushing fluid inlet 42'. A flushing fluid valve 56 is located at the bottom and inside of the cleaning fluid cartridge 46' and prevents flushing fluid from entering the cleaning fluid cartridge 46' from the flushing fluid cartridge 36'. The flushing fluid valve 56 has a plurality of valve holes 57 which are sealed to the wall between the cartridges 36', 46'.

FIG. 3A shows the cleaning and flushing system 30' having the outer piston 55 and the inner piston 54 positioned near the top of the flushing fluid cartridge 36' and the cleaning fluid cartridge 46', respectively. This implies that both the flushing fluid cartridge 36' and the cleaning fluid cartridge 46' are filled with flushing fluid and cleaning fluid, respectively. As the inner piston 54 presses the pressure fluid through the beverage of the beverage outlet 24', the inner piston 54 will act on the flushing fluid valve 56 and push the flushing fluid valve 56 into a valve recess 58. When the flushing fluid valve 56 has contacted the bottom of the valve recess 58 the inner piston 54 will have come to its final position and the valve holes 57 located in the flushing fluid valve 56 will be in registration with the flushing fluid inlet 42'. Fluid communication is established between the flushing fluid cartridge 36' and the cleaning fluid cartridge 46 via the valve holes 57 and the flushing fluid inlet 42'.

FIG. 3B shows the flushing fluid being pressed out of the beverage outlet 24' by the outer piston 55 while pressure fluid is allowed to enter the upper space of the flushing fluid cartridge 36' through the pressure fluid inlet 44'. When the outer piston 55 has reached its final position the outer piston 55 will prevent pressure fluid from entering the beverage outlet 24', thereby eliminating the need for a ball valve for this purpose. The present embodiment has the advantage of physically separating the pressure fluid from the flushing and cleaning fluids and it may therefore preferably be used in connection with a liquid pressure fluid. Such liquid pressure fluids may include water and may additionally provide cooling to the pressure chamber 10.

Figure 4:
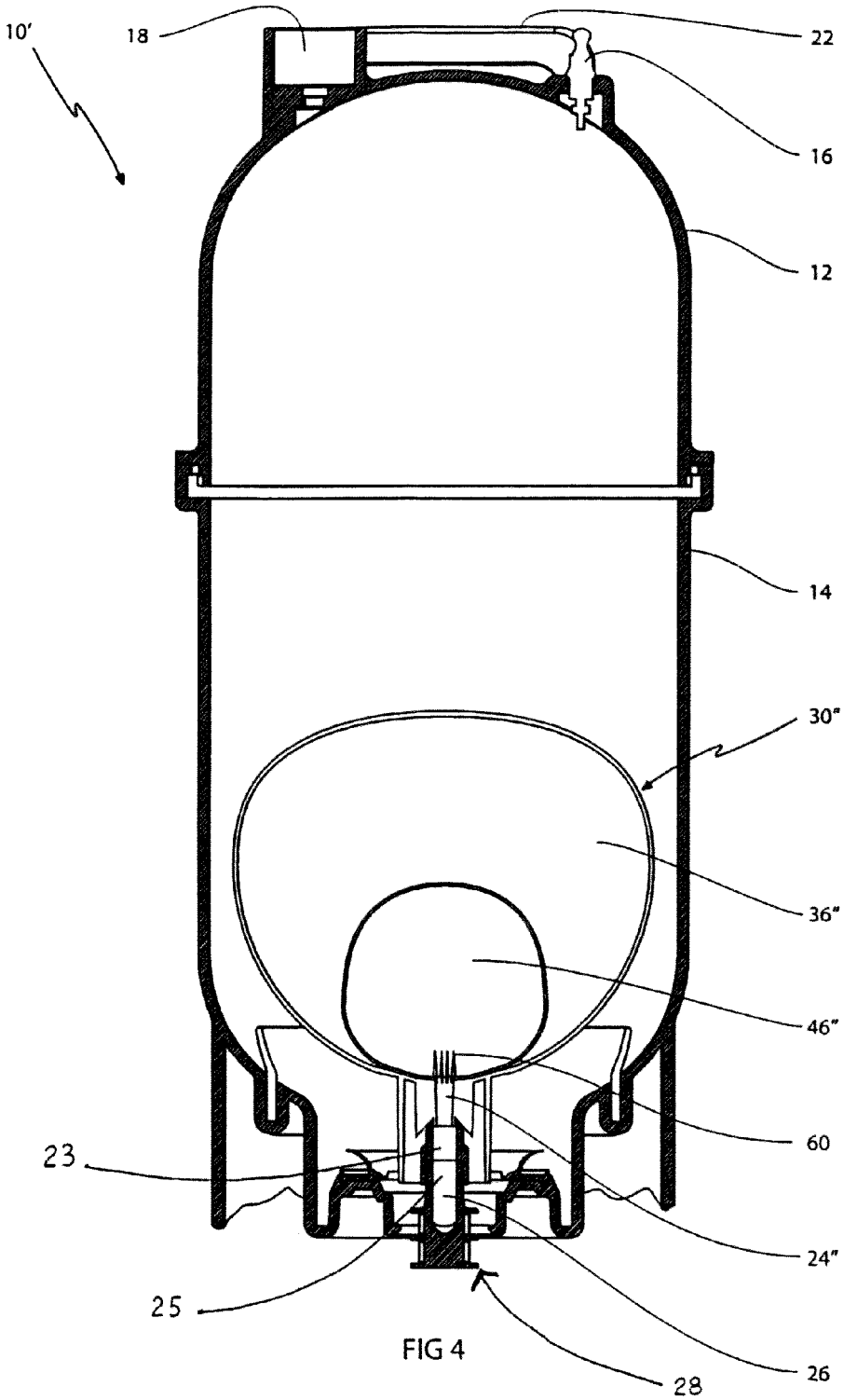
FIG. 4 is a cross-sectional view of a pressure chamber having a collapsible cleaning and flushing cartridge.

FIG. 4 illustrates a further embodiment of the cleaning and flushing system 30" located inside the pressure chamber 10'. The cleaning and flushing system 30" comprises a flushing fluid cartridge 36" and a cleaning fluid cartridge 46" located inside the flushing fluid cartridge 36". The wall dividing the pressure chamber 10' and the flushing fluid cartridge 36" is made collapsible and non-piercable, preferably made of a thicker but yet collapsible material such as PET plastic. The wall between the flushing fluid cartridge 36" and the cleaning fluid cartridge 46" is made collapsible and pierceable, and preferably it is made by a thin plastic material and may constitute e.g. a plastic bag. The beverage outlet 24" is in fluid communication with the cleaning fluid container 46" and comprises a piercing element 60. The previous mentioned features non-piercable and piercable should be understood in relation to the piercing element 60, i.e. non-piercable material means the piercing element 60 may not penetrate the material while piercable material means the piercing element 60 may penetrate the material.

When the pressure chamber 10' is pressurized, the pressure will act on to the flushing fluid cartridge 36" which will in turn act on the cleaning fluid cartridge 46" such that both cartridges will collapse and cleaning fluid will leave through the beverage outlet 24". When substantially all cleaning fluid has left the cleaning fluid cartridge 46" the wall between the cleaning fluid cartridge 46" and the flushing fluid cartridge 36" will collapse into the piercing element 60. The piercing element 60 comprises a sharp end which will pierce a hole into the wall between the cleaning fluid cartridge 46" and the flushing fluid cartridge 36" allowing the flushing fluid to leave the flushing fluid cartridge 36" through the beverage outlet 24". When substantially all the flushing fluid has left the flushing fluid cartridge 36", the flushing fluid cartridge 36" will be completely collapsed. Since the outer wall of the flushing fluid cartridge 36" will not be pierced it does prevent any pressure fluid to leave through the beverage outlet 24".

Figures 5A, 5B, 5C, 5D:
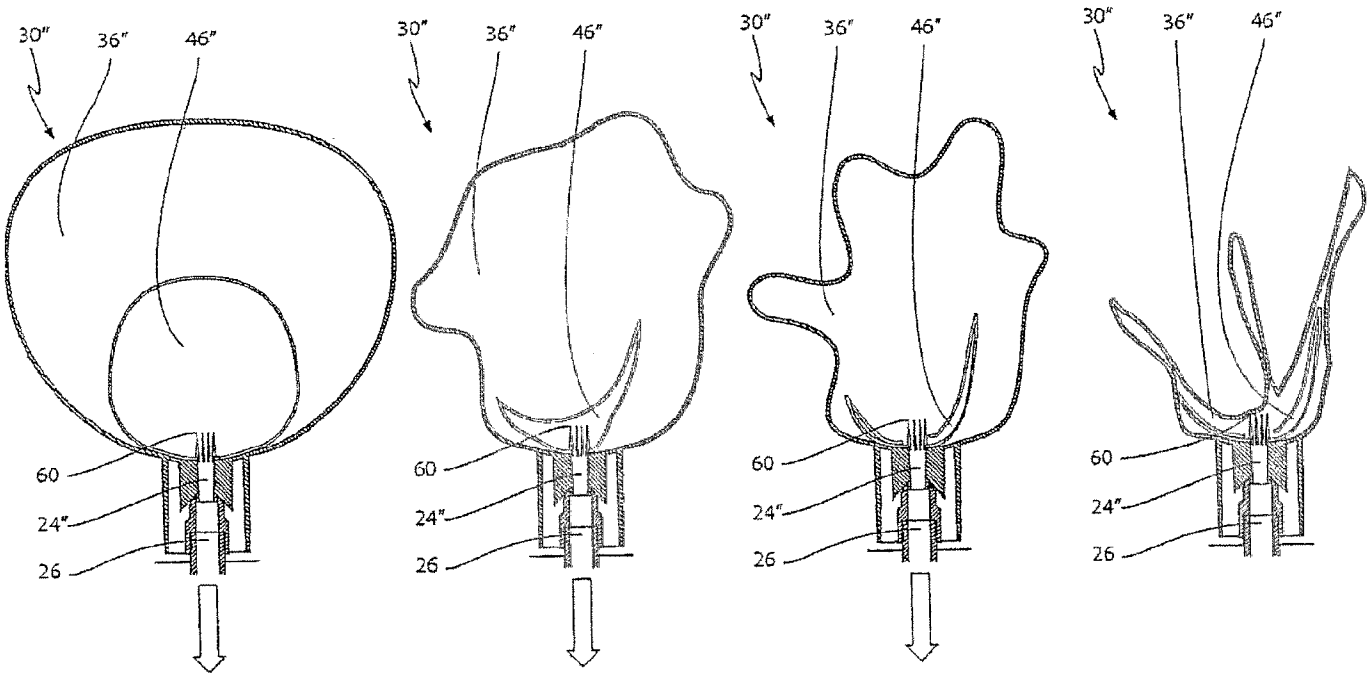
FIGS. 5A-5D illustrate the cleaning and flushing cartridge of FIG. 4 while collapsing.

FIGS. 5A-5D illustrate the cleaning and flushing system 30" and shows the sequence of the cleaning fluid cartridge 46" and the flushing fluid cartridge 36". In FIG. 5A the cleaning fluid is leaving the cleaning fluid cartridge 46", and both cartridges 36", 46" are beginning to collapse. In FIG. 5B substantially all cleaning fluid has left the cleaning fluid cartridge 46", and the cleaning fluid cartridge 46" is collapsing into the piercing element 60. In FIG. 5C the piercing element 60 has penetrated the wall between the cleaning fluid cartridge 46" and the flushing fluid cartridge 36" allowing flushing fluid to leave the flushing fluid cartridge 36" through the beverage outlet 24". In FIG. 5D the flushing fluid cartridge 36" has collapsed and substantially all flushing fluid has left the flushing fluid cartridge 36" through the beverage outlet 24". The piercing element has not penetrated the outer wall of the flushing fluid container and the pressure fluid may thus not escape through the beverage outlet 24".

FIGS. 6A-6D illustrate yet another embodiment of the cleaning and flushing system 30'" according to the present invention. The cleaning and flushing system 30'" comprises a cleaning fluid keg 62 and a separate flushing fluid keg 72, both being collapsible and constituting a cleaning fluid cartridge and a flushing fluid cartridge, respectively. Preferably both the cleaning fluid keg 62 and the flushing fluid keg 72 are made of disposable plastic materials. Since it is often necessary to first apply the cleaning fluid and afterwards the flushing fluid it is necessary to be able to clearly distinguish the kegs 62, 72 for avoiding a confusion and a mix-up between the cleaning fluid keg 62 and the flushing fluid keg 72.

Figures 6A, 6B, 6C, 6D:
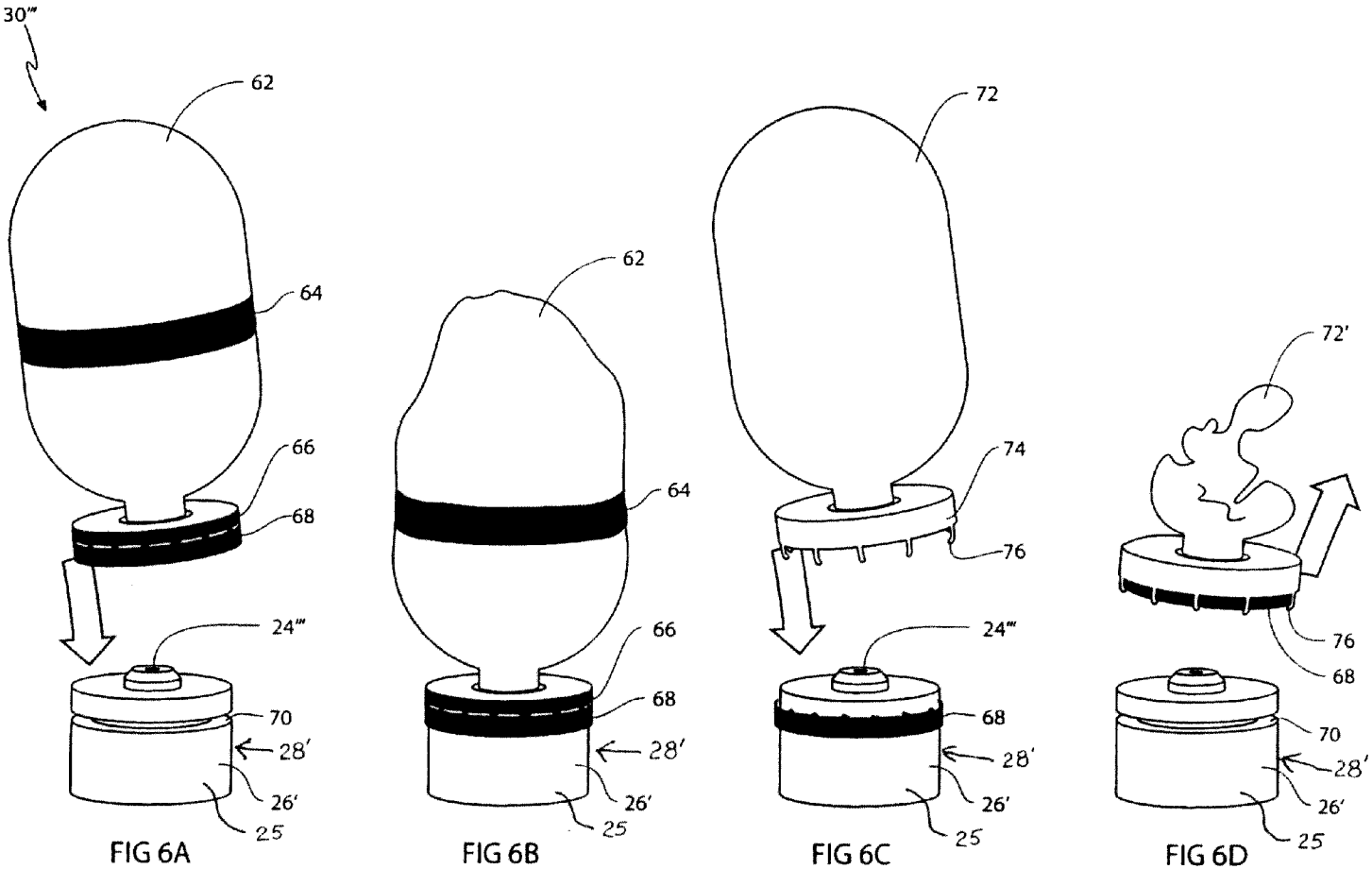
FIGS. 6A-6D illustrate a cleaning cartridge and a separate flushing cartridge.

In FIG. 6A the cleaning fluid keg 62 is shown marked by a warning ribbon 64 distinguishing the cleaning fluid keg 62 from the flushing fluid keg 72 and informing the user about the properties of the cleaning fluid. The cleaning fluid may also have a different color for distinguishing it from the flushing fluid and the beverage. The cleaning fluid keg 62 additionally comprises a first type base part 66 which fits on a dispensing valve 26'. The first type base part 66 has a base rim 68 loosely attached to the lower part of the first type base part 66. With loosely should be understood that the base rim 68 may be broken off the first type base part 66 by the use of a moderate force. The dispensing valve 26' has a groove 70 for communicating with the base rim 68.

In FIG. 6B the first type base part 66 is shown positioned on the dispensing valve 26' such that the cleaning fluid keg 62 is in fluid communication with the beverage outlet 24'". When the first type base part 66 is positioned on the dispensing valve 26' the base rim 68 will interact with the groove 70 such that when the cleaning fluid keg 62 is removed, the base rim 68 is broken off the first type base part 66, i.e. the base rim 68 remains with the dispensing valve 26' and the first type base part 66 is still fixated to the cleaning fluid keg 62. When the cleaning fluid keg 62 has been placed in the pressure chamber 10 and the pressure chamber 10 is pressurized, the cleaning fluid keg 62 will collapse and the cleaning fluid will be dispensed through the beverage dispensing system. The base rim 68 will prevent any beverage keg and/or additional cleaning fluid keg 62 from being positioned on the dispensing valve 26'.

FIG. 6C shows the flushing fluid keg 72 comprising a second type base part 74. The second type base part 74 has no base rim but instead a set of gripping claws 76 protruding downwards in relation to the second base part 74. The second type base part 74 may be placed on the dispensing valve 26' and fluid communication may be established between the flushing fluid keg 72 and the beverage outlet 24'" even if the base rim 68 is present on the dispensing valve 26. The second base part 74 may be placed such that the gripping claw 76 fits around the base rim 68. When the pressure chamber 10 is pressurized the flushing fluid may be dispensed through the beverage dispensing system and the flushing fluid keg 72 thereby collapses.

FIG. 6D shows the flushing fluid keg 72 being removed. When removing the flushing fluid keg 72 from the dispensing valve 26', the gripping claws 76 of the second type base part 74 will grip around the base rim 68 such that the base rim 68 is removed from the dispensing valve 26' together with the second type base part 74.

When the base rim 68 is placed on the flushing fluid keg 72, it can only be removed by the use of the flushing fluid keg 72 and corresponding second base part 74 and gripping claws 76. If an attempt is made to place the cleaning fluid keg 62 or a beverage container on to the dispensing valve 26', the base rim 68 will prevent the first base part 66 from being properly installed preventing fluid communication between the cleaning fluid keg 62 or the beverage keg and the beverage outlet 24'''. The base rim 68 thus acts as a physical barrier preventing any confusion or mix-up between the kegs 62, 72.

The words upper, lower, top and bottom should be understood in relation to the figures and in particular in relation to the beverage dispensing unit when it is ready for use.

Typical volume of cleaning fluid is about 0.5-1.5 liter, and the volume of flushing fluid may typically range between 1-3 liters. More of less fluid may be required depending on the exact chemical compositions of the fluid.

In some embodiments it may be preferred to allow some pressure fluid to escape to the outside of the dispensing device with the purpose of forcing all of the flushing fluid out of the beverage dispensing system. In those embodiments the pressure level should be chosen to not pose a hazard to the surroundings, e.g. by using a flow restrictor.

Although the present invention has been described above with the reference to specific embodiments of the cleaning and flushing system, it is of course to be contemplated that numerous modifications be deduced by a person having ordinary skill in the art, and modifications readily perceivable by a person having ordinary skill in the art are consequently to be construed part of the present invention as defined in the appending claims.

LIST OF PARTS WITH REFERENCE TO THE FIGURES

| | |
|---|---|
| 10. | Pressure chamber |
| 12. | Pressure lid |
| 14. | Receptacle |
| 16. | Safety valve |
| 18. | Pressure fluid intake |
| 20. | Seal |
| 22. | Handle |
| 23. | Pressure Chamber Outlet |
| 24, 24', 24'', 24'''. | Beverage outlet |
| 25, 25'. | Dispensing Line |
| 26, 26'. | Dispensing valve |
| 28, 28'. | Dispensing device |
| 30, 30', 30'', 30'''. | Cleaning and flushing system |
| 32. | Handle |
| 34. | Cartridge lid |
| 36, 36', 36''. | Flushing fluid cartridge |
| 38. | Flushing fluid outlet |
| 40. | Cartridge interconnection |
| 42, 42'. | Flushing fluid inlet |
| 44, 44'. | Pressure fluid inlet |
| 46, 46', 46''. | Cleaning fluid cartridge |
| 48. | Auxiliary pressure fluid inlet |
| 50. | Float valve |
| 52. | Float valve support |
| 54. | Inner piston |
| 55. | Outer piston |
| 56. | Flushing fluid valve |
| 57. | Valve holes |
| 58. | Valve recess |
| 60. | Piercing element |
| 62. | Cleaning fluid keg |
| 64. | Warning ribbon |
| 66. | First type base part |
| 68. | Base rim |
| 70. | Groove |
| 72. | Flushing fluid keg |
| 74. | Second type base part |
| 76. | Gripping claw |

The invention claimed is:

1. A method of cleaning and flushing a beverage dispensing system comprising a sealable pressure chamber for receiving a collapsible keg containing a beverage, said pressure chamber having a beverage outlet, said collapsible keg being detachably connectable to said beverage outlet so as to be in fluid communication therewith, said beverage dispensing system further comprising a pressure fluid source connected to said pressure chamber for pressurizing said pressure chamber, a dispensing line, a dispensing valve, and a dispensing device, said dispensing valve being operably associated with said dispensing device, said dispensing line having a proximal end fluidly connected to said beverage outlet and a distal end fluidly connected to said dispensing valve, said dispensing valve having a closed position and an open position, said open position allowing said beverage to be dispensed from said dispensing device when said pressure chamber is pressurized, and said closed position preventing said beverage from being dispensed from said dispensing device, the method comprising:

(i) providing a first cartridge containing a cleaning fluid, said first cartridge comprising a first base part configured for detachable connection to said dispensing line in fluid communication with said beverage outlet, said first base part being detachably attached to a rim element:

(ii) positioning said first cartridge in said pressure chamber and connecting said first base part to said dispensing line in fluid connection with said beverage outlet, and pressurizing said pressure chamber and said first cartridge;

(iii) opening said dispensing valve and dispensing said cleaning fluid from said dispensing device by causing said cleaning fluid to flow from said first cartridge through said first base part, said beverage outlet, said dispensing valve, and said dispensing line to be dispensed from said dispensing device;

(iv) removing said first cartridge from said pressure chamber by detaching said first base part from said dispensing line and said rim element, thereby separating said rim element from said first base part and leaving said rim element on said dispensing line;

(v) providing a second cartridge containing a flushing fluid, said second cartridge comprising a second base part configured for detachable connection to said dispensing line in fluid communication with said beverage outlet, said second base part including a gripping element;

(vi) positioning said second cartridge in said pressure chamber and connecting said second base part to said dispensing line in fluid connection with said beverage outlet, so that said gripping element attaches to said rim element, and pressurizing said pressure chamber and said second cartridge;

(vii) opening said dispensing valve and dispensing said flushing fluid from said dispensing device by causing said flushing fluid to flow from said second cartridge through said second base part, said beverage outlet, said dispensing valve, and said dispensing line, to be dispensed from said dispensing device; and (viii) removing said second cartridge from said pressure chamber by disconnecting said second base part from said dispensing line and thereby removing said rim element from said dispensing line with said gripping element.

2. A method of cleaning and flushing a beverage dispensing system comprising a sealable pressure chamber for receiving a collapsible keg containing a beverage, said pressure chamber having a beverage outlet, said collapsible keg being detachably connectable to said beverage outlet so as to be in fluid communication therewith, said beverage dispensing system further comprising a pressure fluid source connected to said pressure chamber for pressurizing said pressure chamber, a dispensing line, a dispensing valve, and a dispensing device, said dispensing valve operably associated with said dispensing device, said dispensing line defining a proximal end fluidly connected to said beverage outlet and a distal end fluidly connected to said dispensing valve, said dispensing valve having a closed position and an open position, said open position allowing said beverage to be dispensed from said dispensing device when said pressure chamber is pressurized, and said closed position preventing said beverage from being dispensed from said dispensing device, the method comprising:

(i) providing a multi-chambered cartridge comprising a first chamber containing a cleaning fluid and a second chamber containing a flushing fluid;

positioning said multi-chambered cartridge in said pressure chamber, connecting said first chamber in fluid communication with said beverage outlet, and pressurizing said pressure chamber and said multi-chamber cartridge by means of a pressure fluid from said pressure fluid source;

(iii) opening said dispensing valve and causing said cleaning fluid to flow from said first chamber past said beverage outlet and through said dispensing line until said first chamber is empty;

(iv) when said first chamber is empty, causing said flushing fluid to flow from said second chamber through said first chamber and said beverage outlet through said dispensing line until said second chamber is empty;

(v) disconnecting said multi-chambered cartridge from said beverage outlet after said second chamber is empty; and (vi) removing said multi-chambered cartridge from said pressure chamber.

3. The method according to claim 2, wherein said multi-chambered cartridge comprises:

a fluid inlet coupled to said second chamber so as to establish fluid communication from said pressure chamber to said second chamber and to allow a pressure in said pressure chamber to be conveyed to said second chamber; and a chamber connection connecting said first and second chambers so as to establish fluid communication from said second chamber to said first chamber, and so as to convey a pressure in said second chamber to said first chamber.

4. The method according to claim 3, wherein said multi-chambered cartridge defines an emptying position for dispensing said cleaning and flushing fluids, in which emptying position said first chamber defines a first upper end and a first lower end, and said second chamber defines a second upper end and a second lower end, said fluid inlet being located at said second upper end of said second chamber, said chamber connection being connected to said second chamber at the second lower end and to said first chamber at the first upper end, said multi-chambered cartridge outlet being connectable to said beverage outlet at said first lower end.

5. The method according to claim 4, wherein said pressure fluid source generates pressurized gas when pressurizing said pressure chamber, and wherein said first chamber further comprises a float valve located at the first lower end, said float valve being operable to prevent said pressurized gas from entering said dispensing line when said second chamber is empty.

6. The method according to claim 2, wherein said multi-chambered cartridge is collapsible and further comprises:

a partition separating said first and second chambers prior to the dispensing of said cleaning fluid; and a piercing element operably associated with said beverage outlet and configured to create an opening in said partition when said first chamber is empty, thereby enabling the subsequent dispensing of said flushing fluid through said opening and said beverage outlet.

7. The method according to claim 6, wherein said multi-chambered cartridge defines an empty position for dispensing said cleaning and flushing fluids, and wherein, prior to the dispensing of said cleaning fluid, the volume of said cleaning fluid defines a first center-of-gravity, the volume of said flushing fluid defining a second center-of-gravity, and wherein, when said multi-chambered cartridge is in said empty position, said first center-of-gravity is located below said second center-of-gravity.

8. The method according to claim 2, wherein said first chamber defines a first volume and a first direction, along which the cross-section of said first volume is substantially constant, said multi-chambered cartridge further comprising:

a first piston sealing against said first chamber and dividing said cleaning fluid from said pressure chamber, said first piston being operable to convey a pressure in said pressure chamber to said first chamber;

a flushing fluid valve connected between said first and second chambers and having a closed position and an open position, said flushing fluid valve being in its closed position when dispensing said cleaning fluid and said first piston is moving along said first direction, wherein said flushing fluid valve is operable by said first piston to change from the closed position to the open position when said first chamber is empty, thereby allowing said flushing fluid to be dispensed through said flushing fluid valve to said beverage outlet.

9. The method according to claim 8, wherein said second chamber defines a second volume and a second direction, along which the cross-section of said second volume is substantially constant, and wherein said multi-chambered cartridge further comprises a second piston sealing against said second chamber and dividing said flushing fluid from said pressure chamber, said second piston being operable to convey a pressure from the pressure chamber to said second chamber, said second piston moving along said second direction when dispensing said flushing fluid.

10. A cleaning and flushing system for a beverage dispensing system, comprising a sealable pressure chamber for receiving a collapsible keg containing a beverage, said pressure chamber having a beverage outlet, said collapsible keg being detachably connectable to said beverage outlet so as to be in fluid communication therewith, said beverage dispensing system further comprising a pressure fluid source connected to said pressure chamber for pressurizing said pressure chamber, a dispensing line, a dispensing valve, and a dispensing device, said dispensing valve being operably associated with said dispensing device, said dispensing line defining a proximal end connected to said beverage outlet and a distal end connected to said dispensing valve, said dispensing valve having a closed position and an open position, said open position allowing said beverage to be dispensed from said dispensing device when said pressure chamber is pressurized, and said closed position preventing said beverage from being dispensed from said dispensing device, wherein the cleaning and flushing system comprises:

a first cartridge containing a cleaning fluid and configured for removable installation in said pressure chamber;

a first base part on said first cartridge configured to detachably connect to said dispensing line;

a rim element detachably attached to said first base part so as to remain on said dispensing line when said first base part is detached from said dispensing line;

a second cartridge containing a flushing fluid and configured for removable installation in said pressure chamber; and a second base part on said second cartridge configured to detachably connect to said dispensing line, and to attach to said rim element so as to remove said rim element from said dispensing line when said second base part is detached from dispensing line.

11. A cleaning and flushing system for a beverage dispensing system comprising a sealable pressure chamber for receiving a collapsible keg containing a beverage, said pressure chamber having a beverage outlet, said collapsible keg being detachably connectable to said beverage outlet so as to be in fluid communication therewith, said beverage dispensing system further comprising a source of pressurized fluid connected to said pressure chamber for pressurizing said pressure chamber, a dispensing line, a dispensing valve, and a dispensing device, said dispensing valve being operably associated with said dispensing device, said dispensing line defining a proximal end connected to said beverage outlet and a distal end connected to said dispensing valve, said dispensing valve having a closed position and an open position, said open position allowing said beverage to be dispensed from said dispensing device when said pressure chamber is pressurized with said pressurized fluid, and said closed position preventing said beverage from being dispensed from said dispensing device, said cleaning and flushing system comprising:

a multi-chambered cartridge comprising a first chamber containing a cleaning fluid and a second chamber containing a flushing fluid, said multi-chambered cartridge being configured to be positioned in said pressure chamber and detachably connected to said beverage outlet, said first and second chambers being mutually arranged so that when said pressure chamber is pressurized with said pressurized fluid and said dispensing valve is opened, said cleaning fluid is first caused to flow from said first chamber past said beverage outlet and through said dispensing line to be dispensed from said dispensing device, and subsequently said flushing fluid is caused to flow from said second chamber past said beverage outlet and through said dispensing line; and a pressure fluid closure valve located between said multi-chamber cartridge and said beverage outlet, and operable to prevent passage of said pressurized fluid into said dispensing line after said flushing fluid has been dispensed.

* * * * *